US005893497A

United States Patent [19]

Schaiewitz

[11] Patent Number: 5,893,497

[45] Date of Patent: Apr. 13, 1999

[54] UNIVERSAL PAGER CADDY

[76] Inventor: Daniel Schaiewitz, 87 Slocum Ave., Bronxville, N.Y. 10708

[21] Appl. No.: 09/042,106

[22] Filed: Mar. 13, 1998

[51] Int. Cl.[6] ..... A45F 5/02

[52] U.S. Cl. ..... 224/182; 224/255; 224/269; 224/930; 24/3.3; 24/3.12

[58] Field of Search ..... 224/182, 191, 224/269, 255, 930; 24/3.3, 3.11, 3.12; 63/20; D3/218

[56] References Cited

U.S. PATENT DOCUMENTS

| | | | |
|---|---|---|---|
| 467,263 | 1/1892 | McGervey | 224/182 |
| 1,795,963 | 3/1931 | Oborski | 224/182 X |
| 2,493,940 | 1/1950 | Ballou, Jr. | 63/20 |
| 3,956,795 | 5/1976 | Kosakai | 24/3.3 |
| 5,647,099 | 7/1997 | Cohen | 24/3.3 |
| 5,752,632 | 5/1998 | Sanderson et al. | 224/930 X |

*Primary Examiner*—Allan N. Shoap
*Assistant Examiner*—Gregory M. Vidovich
*Attorney, Agent, or Firm*—Richard A. Joel, Esq.

[57] ABSTRACT

A universal pager caddy comprises a transverse bar having a pivotal pin connected at one end and a locking catch at the other end to engage the free end of the pin. A downwardly extending support member is mounted to the opposite side of the bar at each end curving outwardly and then downwardly in a substantially U-shaped configuration. The pager caddy is pinned to clothing in whatever location the user deems appropriate eliminating the traditional belt mounting. A pager clip is then readily inserted between the bar and the support member with the member engaging the back of the pager case securely holding the pager in a convenient selected location.

6 Claims, 1 Drawing Sheet

UNIVERSAL PAGER CADDY

BACKGROUND OF THE INVENTION

The present invention relates to devices for securely and conveniently carrying and using telephone pagers, beepers or cellular phones. Generally pagers and the like are mounted on the user's belt and held there by a spring biased clip. An alternate arrangement is disclosed in applicant's patent U.S. Pat. No. 5,398,855 which issued Mar. 21, 1995 on a Pager Carrying Device. This patent discloses a knitted cord for carrying a pager and is not relevant to the present invention.

Another method involves clipping pagers to jewelry chains which is ungainly, unsatisfactory and generally unattractive. With the increase in the use of pagers and other means of mobile communication, the public recognizes the need for a pager caddy which may be attached other than to the user's belt.

The problem is particularly acute with women who may not be wearing a belt and, in any event, desire a more convenient and attractive means for carrying a pager. This invention solves the foregoing problems.

SUMMARY OF THE INVENTION

This invention relates to pager carrying devices and more particularly to a universal pager caddy for conveniently and attractively carrying pagers, beepers and other mobile communication means. The caddy basically permits the user to clip or pin the caddy anywhere on their person and then attach the pager to the caddy. An individual is not limited to clipping the pager on their belt.

More specifically, the pager caddy comprises an elongated horizontal member or bar having a pivotal pin mounting at one of its outer ends and a locking catch mounted at the other outer end. A substantially U-shaped member extends in an initial downward curve from each inner end of the horizontal member and then proceeds substantially vertically and curves at its lower end to form the base of the "U".

A pager is mounted to the caddy with the spring urged clip of the case extending between the outer surface of the horizontal member and the inner surface of the U-shaped member with the outer surface of the U-shaped member engaging the rear of the pager case to maintain the pager in a vertical position. A projection on the inner base of the U-shaped member engages the clip to hold the pager securely in position. The pin may be affixed to one's clothing in any convenient position and the pager readily attached thereto.

Accordingly, an object of this invention is to provide a new and improved caddy for carrying pagers.

Another object of this invention is to provide a new and improved caddy for pagers and the like which may be affixed to one's clothing in any convenient position.

A further object of this invention is to provide an inexpensive and attractive means for carrying pagers and the like without being forced to clip the pagers on one's belt or carry it elsewhere such as in a pocketbook or pocket.

A more specific object of this invention is to provide a new and improved universal pager caddy which can be readily affixed to one's clothing by pin means and includes means for securely and inconspicuously mounting the pager thereto, comprising a member having spaced legs extending downwardly at one end from an elongated member and a intermediate portion joining said legs at the other end so that the pager clip is mounted between the elongated member and the joined legs.

BRIEF DESCRIPTION OF THE DRAWINGS

The above and other objects and advantages of this invention may be more clearly seen when viewed in conjunction with the accompanying drawings wherein.

DETAILED DESCRIPTION OF THE INVENTION

Figure 1:
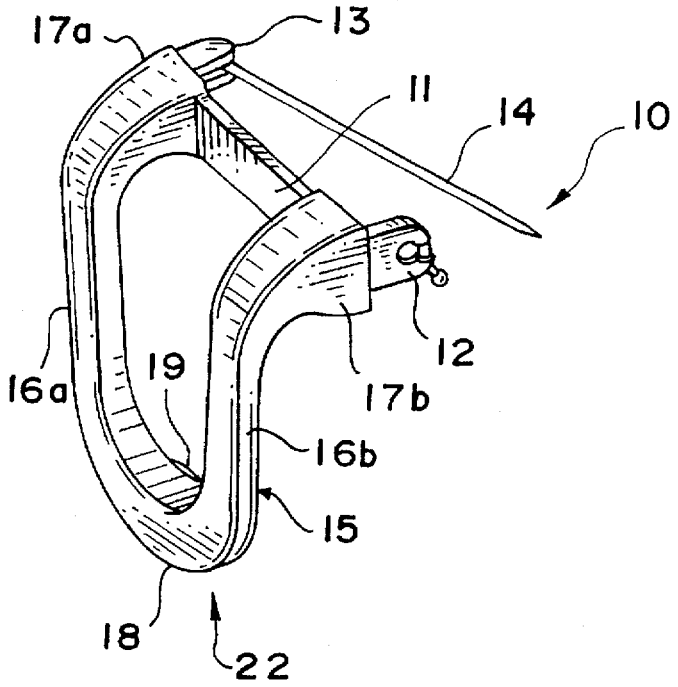
FIG. 1 is a perspective view of the invention.
Figure 2:
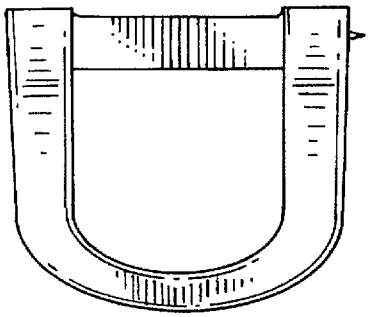
FIG. 2 is a front view of the invention.
Figure 3:
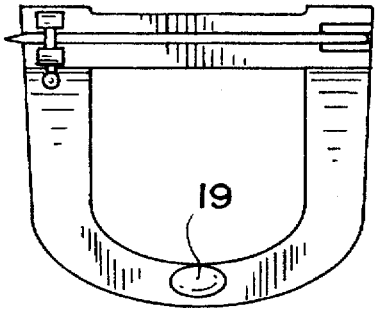
FIG. 3 is rear view of the invention.
Figure 4:
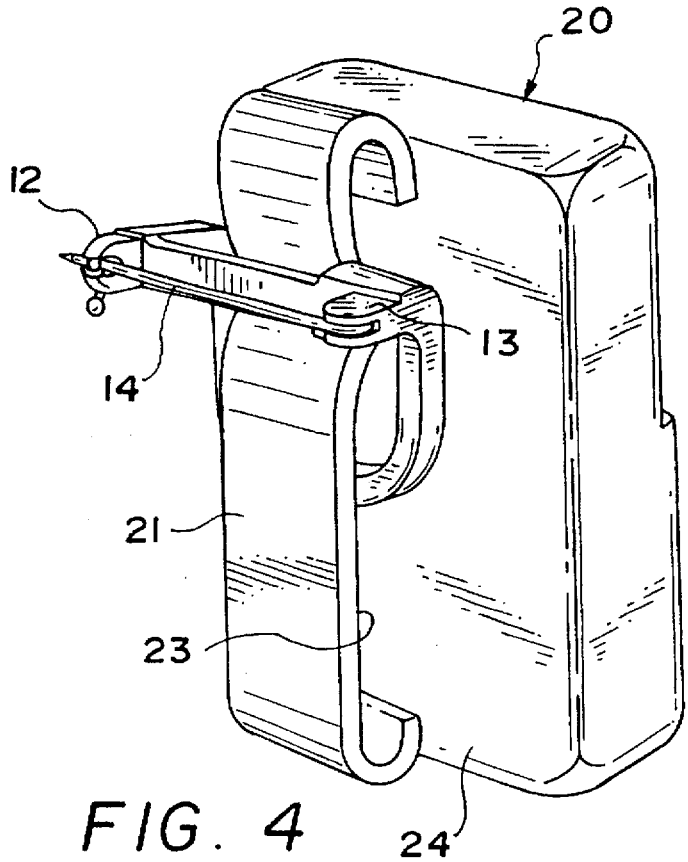
FIG. 4 is a perspective view of the universal pager caddy with a pager mounted thereto.

Referring now to the drawings this invention relates to pagers and particularly to a universal pager caddy 10 for carrying a pager 20 on one's clothing. This invention eliminates the need to carry a pager 20 on one's belt and is particularly convenient for women. Basically, this pager caddy 10 permits attaching the pager anywhere on one's clothing in a convenient and suitable location.

The caddy 10 comprises an elongated flat member 11 having an outwardly projecting locking catch 12 mounted at one end and an outwardly projecting pivot 13 having a pin 14 which may be made of metal pivotally mounted thereto at one end. The locking catch 12 may also comprise a conventional curved member (not shown) which would hold the resiliently biased end of the pin 14. The pin 14 extends substantially parallel to the flat member 11 at a spaced distance therefrom determined by the locking catch 12 and projecting pivot 13.

A substantially U-shaped member 15 is mounted on the other side of the flat member 11 with the legs **16*a* and 16*b* of the "U" extending upwardly and then curving inwardly to engage the ends of the flat member 11. The curved portions 17*a*, 17*b* extend outwardly a predetermined distance from the member 11 where they are permanently affixed. The base 18 of the U-shaped member 15 includes a projection 19 extending outwardly a predetermined distance from the inner surface-to engage the pager clip 21**.

In use, the caddy 10 is pinned to one's clothing and the pin 14 secured in the locking catch 12. A pager 20 is then assembled to the U-shaped member 15 which may be made of metal or plastic, by inserting the pager clip 21 between the flat member 11 and the U-shaped member 15. The front surface 22 of the member 15 engages the rear 24 of the pager 20 while the projection 19 engages the interior surface 23 of the clip 21 to hold the pager 20 firmly in position on the carrier or caddy 10.

Alternatively, the U-shaped member 15 may comprise a rectangular type member having substantially straight legs extending downwardly from the curved portions **17*a*, 17*b*. The legs would be joined by a cross-member extending substantially parallel to the flat member 11. Also the projection 19 may extend outwardly on both sides of the base 18**.

The pin 14 may then be affixed to clothing wherever the user considers convenient and locked in position with the locking catch 12. This eliminates the pager 20 from digging into an individual or being otherwise uncomfortable. The caddy 10 is basically hidden from view by the pager 10. The caddy 10, as thus proposed, is also small, lightweight and inexpensive. Of course, alternate constructions may be envisioned where the pin 10 is extended beyond the pager 20 and is a jewelry item.

While the invention has been explained by a detailed description of certain specific embodiments, it is understood that various modifications and substitutions can be made in any of them within the scope of the appended claims which are intended also to include equivalents of such embodiments.

What is claimed, is:

1. A universal pager caddy for carrying a pager with a clip on a user's clothing comprises:

an elongated flat member;

a pivotal mounting and a locking catch respectively mounted on one side at opposite ends of the flat member and projecting outwardly therefrom;

a pin mounted at one end in the pivotal mounting and having a second end engageable in the locking catch; and, a substantially U-shaped member having an outwardly projecting curved portion at each of its upper ends, said ends being mounted to the other side of the flat member and having downwardly extending legs each joined at a lower end thereof to a base, wherein the pager clip is adapted to be inserted between the legs of the U-shaped member with the legs engaging the pager and the flat member engaging the pager clip and wherein the pin is adapted to be mounted to the user's clothing.

2. A universal pager caddy in accordance with claim 1 further including:

an outwardly projecting portion at the base of the U-shaped member which engages the pager clip on one side thereof and the elongated member engages the clip on the other side thereof maintaining the pager in position when pager clip is inserted between the legs.

3. A universal pager caddy in accordance with claim 2 wherein:

the caddy is made of metal and is of relatively small size such that when the pager is engaged with the caddy, outer extents of the caddy are hidden behind the pager.

4. A universal pager caddy in accordance with claim 2 wherein:

the outwardly projecting portion at the base of the U-shaped member and the curved portion on the upper ends of the U-shaped member extend a predetermined distance to engage the clip and the pager respectively to maintain the pager in a substantially vertical position when the pager clip is inserted between the legs.

5. A universal pager caddy in accordance with claim 1 wherein:

the legs of the U-shaped member are substantially parallel and the base is substantially parallel to the flat member.

6. A universal pager caddy in accordance with claim 1 wherein:

the U-shaped member is made of plastic and the pin of metal.

* * * * *